US010823007B2

(12) United States Patent
Alexander

(10) Patent No.: US 10,823,007 B2
(45) Date of Patent: Nov. 3, 2020

(54) TURBINE SHROUD CONTOUR EXDUCER RELIEF

(71) Applicant: Honeywell International Inc., Morris Plains, NJ (US)

(72) Inventor: Brian D. Alexander, Indianapolis, IN (US)

(73) Assignee: Garrett Transportation I Inc., Torrance, CA (US)

( * ) Notice: Subject to any disclaimer, the term of this patent is extended or adjusted under 35 U.S.C. 154(b) by 341 days.

(21) Appl. No.: 15/865,020

(22) Filed: Jan. 8, 2018

(65) Prior Publication Data

US 2018/0128125 A1 May 10, 2018

Related U.S. Application Data

(62) Division of application No. 14/109,883, filed on Dec. 17, 2013, now Pat. No. 9,863,275.

(51) Int. Cl.

| | |
|---|---|
| ***F01D 25/24*** | (2006.01) |
| ***F01D 5/04*** | (2006.01) |
| ***F01D 9/04*** | (2006.01) |

(52) U.S. Cl.

CPC ..... *F01D 25/24* (2013.01); *F01D 5/043* (2013.01); *F01D 9/04* (2013.01); *F05D 2220/40* (2013.01); *Y10T 29/49243* (2015.01)

(58) Field of Classification Search

CPC ..... F01D 25/23; F01D 5/043; F01D 25/24

See application file for complete search history.

(56) References Cited

U.S. PATENT DOCUMENTS

| | | | | |
|---|---|---|---|---|
| 4,239,452 | A | 12/1980 | Roberts, Jr. | |
| 7,751,917 | B2 * | 7/2010 | Rees | G06F 30/00 700/97 |
| 8,364,378 | B2 | 1/2013 | De Graaff et al. | |
| 2011/0243711 | A1 | 10/2011 | Vehr | |
| 2016/0160672 | A1 | 6/2016 | Takata et al. | |

FOREIGN PATENT DOCUMENTS

| | | | |
|---|---|---|---|
| DE | 4411678 | A | 10/1995 |
| GB | 2417293 | A | 2/2006 |
| GB | 2484165 | A | 4/2012 |
| WO | WO 2014/203372 | A1 | 12/2014 |

OTHER PUBLICATIONS

EPO, "Communication" including an Extended European Search Report and a Search Opinion, for counterpart European Patent Application No. EP 14193961.1, dated Jul. 20, 2015.

SIPO, "First Office Action", for counterpart Chinese Patent Application No. CN 201410776572.9, dated May 24, 2017, including a partial English translation.

* cited by examiner

*Primary Examiner* — Kenneth Bomberg
*Assistant Examiner* — Michael L Sehn
(74) *Attorney, Agent, or Firm* — The Law Office of John A. Griecci

(57) ABSTRACT

A turbocharger turbine having a blade-gap zone between the blades and the shroud wall. The blade-gap zone is larger at and near the exducer than at an upstream location where the shroud wall is at its minimum radius. Also disclosed is a method of customizing and manufacturing a turbine by establishing an optimized blade-gap zone at the exducer, and machining it into a turbine housing.

6 Claims, 7 Drawing Sheets

TURBINE SHROUD CONTOUR EXDUCER RELIEF

The present application is a Divisional Application of U.S. patent application Ser. No. 14/109,883, filed Dec. 17, 2013, which is incorporated herein by reference for all purposes.

The present invention relates generally to turbocharger turbines and, more particularly, to a turbocharger turbine having a shroud relief at the exducer.

BACKGROUND OF THE INVENTION

With reference to FIG. 1, a turbocharger turbine will generally include a housing 11, and a wheel 13 having a hub 15 and plurality of blades 17. The housing and wheel typically define a fluid passageway serially including a spiral volute portion 21, an inlet passageway 23 radially inward of the volute portion (and usually extending radially), a blade passageway 25 that extends from blade leading edges 27 to blade trailing edges 29, and an outlet passageway 31 that extends downstream from the blade trailing edges. Optionally, the inlet passageway may extend through static or variable vanes 35.

The fluid passageway is serially defined on an inner side by an inlet inner housing wall 33 (throughout the inlet), and by the wheel hub 15 (throughout the blade passageway). The fluid passageway is serially defined on an outer side by an inlet outer housing wall 41 (throughout the inlet), a shroud wall 43 (throughout the blade passageway) that conforms to outer edges 45 of the blades, and an outlet housing wall 47 typically extending cylindrically downstream from the trailing edges to and endpoint. At the endpoint, there is a mechanical connection, such as to an exhaust system or a transition to a second turbine. From the standpoint of airflow, the transition provides an abrupt change to the geometry of the passageway.

A manufacturer of turbochargers, such as vehicle turbochargers, generator turbochargers and the like, may design a turbocharger turbine for production, and wish to sell it to various manufacturers (e.g., vehicle makers). Problematically, each manufacturer will have different requirements for the turbines. These requirements can be in numerous categories, such as flow rates, mechanical efficiency and outlet temperatures.

Accordingly, there has existed a need for a single turbine that can meet varying manufacturing requirements. Preferred embodiments of the present invention satisfy these and other needs, and provide further related advantages.

SUMMARY OF THE INVENTION

In various embodiments, the present invention solves some or all of the needs mentioned above, providing a single turbine that can meet varying manufacturing requirements.

The typical embodiments, the invention provides a turbocharger turbine, including a turbine housing and a turbine wheel within the housing. The turbine wheel is characterized by an axis of rotation about which the wheel rotates, and has a plurality of blades. Each blade forms a leading edge, a trailing edge and an outer edge, the outer edge extending from the leading edge to the trailing edge. The path traveled by the outer edges of the blades through a rotation of the wheel defines an axially symmetric, smoothly varying, axially concave, outer-blade effective surface. The housing and the wheel define a fluid passageway serially including an inlet passageway upstream of the blades, an outlet passageway downstream of the blades, and a blade passageway that extends from the blade leading edges to the blade trailing edges. The blade passageway is defined on an outer side by a shroud wall of the housing.

A blade-gap zone is defined between the shroud wall and the outer-blade effective surface. The shroud wall features a profile wherein a downstream portion of the shroud wall at the downstream end of the blade-gap zone is thicker at its downstream end than it is at its upstream end. Advantageously, this increase blade-gap zone affects the flow, efficiency and outlet temperature of the turbine, and thus by machining the turbine housing, the housing may be customized to particular flow, efficiency and outlet temperature requirements.

In other typical embodiments, the invention provides a method of designing and manufacturing a turbine to meet design requirements. These design requirements are one or more metrics from the group of metrics including flow, efficiency, and outlet temperature. The method includes the steps of providing a base turbine design, and establishing the one or more metrics for the base turbine design. It further includes the step of providing a database of modification effects for a plurality of sets of turbine housing machining parameters. Each set of turbine housing machining parameters includes one or more parameters from the group of parameters including an extension distance, a radial increase, and a corner geometric configuration for a shroud wall of the turbine housing.

The steps also include the selection of an initial set of turbine housing machining parameters for the base turbine design to create a modified turbine design, and the establishment of the one or more metrics for the modified turbine design. The set of turbine housing machining parameters iteratively reselected, and the one or more metrics for the modified turbine design are reestablished until the metrics are optimized to establish an optimum set of turbine housing machining parameters for the design requirements. Finally, a turbine of the base turbine design is manufactured, and the turbine housing is manufactured to meet the optimum set of turbine housing machining parameters. Advantageously, given a single base turbine design may be customized for individual customers (for example, such as different auto manufacturers) by optimizing the turbine housing machining parameters to meet the individual design requirements of the customers.

Other features and advantages of the invention will become apparent from the following detailed description of the preferred embodiments, taken with the accompanying drawings, which illustrate, by way of example, the principles of the invention. The detailed description of particular preferred embodiments, as set out below to enable one to build and use an embodiment of the invention, are not intended to limit the enumerated claims, but rather, they are intended to serve as particular examples of the claimed invention.

DETAILED DESCRIPTION OF THE PREFERRED EMBODIMENTS

The invention summarized above and defined by the enumerated claims may be better understood by referring to the following detailed description, which should be read with the accompanying drawings. This detailed description of particular preferred embodiments of the invention, set out below to enable one to build and use particular implementations of the invention, is not intended to limit the enumerated claims, but rather, it is intended to provide particular examples of them.

Typical embodiments of the present invention reside in a turbocharger turbine having an exducer wall that is machined to tune the turbine efficiency, flow and exducer temperature.

Figure 1:
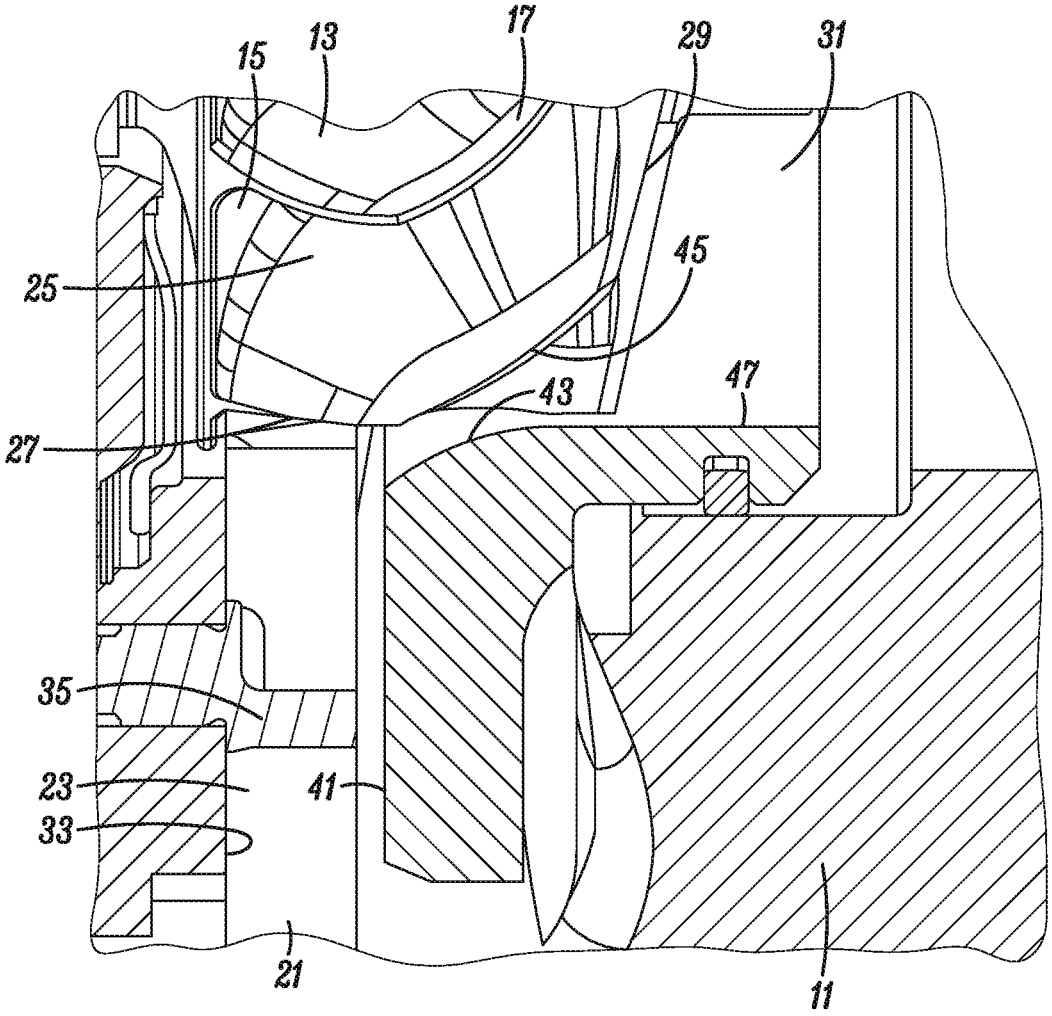
(Prior Art) FIG. 1
FIG. 1 is a cross-section view of a prior art turbine.
Figure 2:
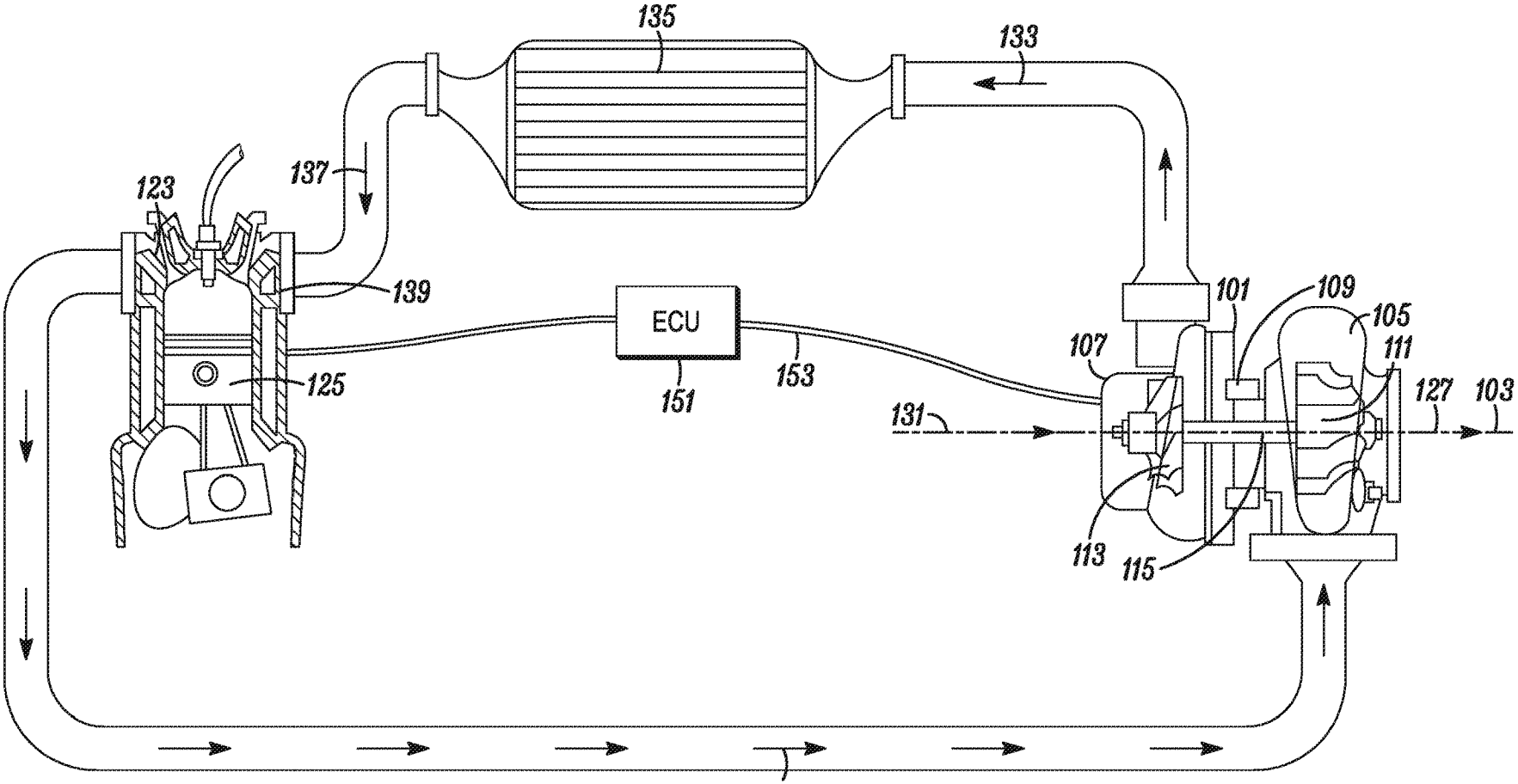
FIG. 2 is a sketch of the basic elements of a first embodiment of a turbocharger, an intercooler and an engine embodying the present invention.

With reference to FIG. 2, in a first embodiment of the invention a turbocharger 101 includes a turbocharger housing and a rotor configured to rotate within the turbocharger housing along an axis of rotor rotation 103 on thrust bearings and two sets of journal bearings (one for each respective rotor wheel), or alternatively, other similarly supportive bearings. The turbocharger housing includes a turbine housing 105, a compressor housing 107, and a bearing housing 109 (i.e., a center housing that contains the bearings) that connects the turbine housing to the compressor housing. The rotor includes a turbine wheel 111 located substantially within the turbine housing, a compressor wheel 113 located substantially within the compressor housing, and a shaft 115 extending along the axis of rotor rotation, through the bearing housing, to connect the turbine wheel to the compressor wheel.

The turbine housing 105 and turbine wheel 111 form a turbine configured to circumferentially receive a high-pressure and high-temperature exhaust gas stream 121 from an engine, e.g., from an exhaust manifold 123 of an internal combustion engine 125. The turbine wheel (and thus the rotor) is driven in rotation around the axis of rotor rotation 103 by the high-pressure and high-temperature exhaust gas stream, which becomes a lower-pressure and lower-temperature exhaust gas stream 127 and is axially released into an exhaust system (not shown). In other embodiments the engine may be of another type, such as a diesel fueled engine.

The compressor housing 107 and compressor wheel 113 form a compressor stage. The compressor wheel, being driven in rotation by the exhaust-gas driven turbine wheel 111, is configured to compress axially received input air (e.g., ambient air 131, or already-pressurized air from a previous-stage in a multi-stage compressor) into a pressurized air stream 133 that is ejected circumferentially from the compressor. Due to the compression process, the pressurized air stream is characterized by an increased temperature, over that of the input air.

Optionally, the pressurized air stream may be channeled through a convectively cooled charge air cooler 135 configured to dissipate heat from the pressurized air stream, increasing its density. The resulting cooled and pressurized output air stream 137 is channeled into an intake manifold 139 on the internal combustion engine, or alternatively, into a subsequent-stage, in-series compressor. The operation of the system is controlled by an ECU 151 (engine control unit) that connects to the remainder of the system via communication connections 153.

Figure 3:
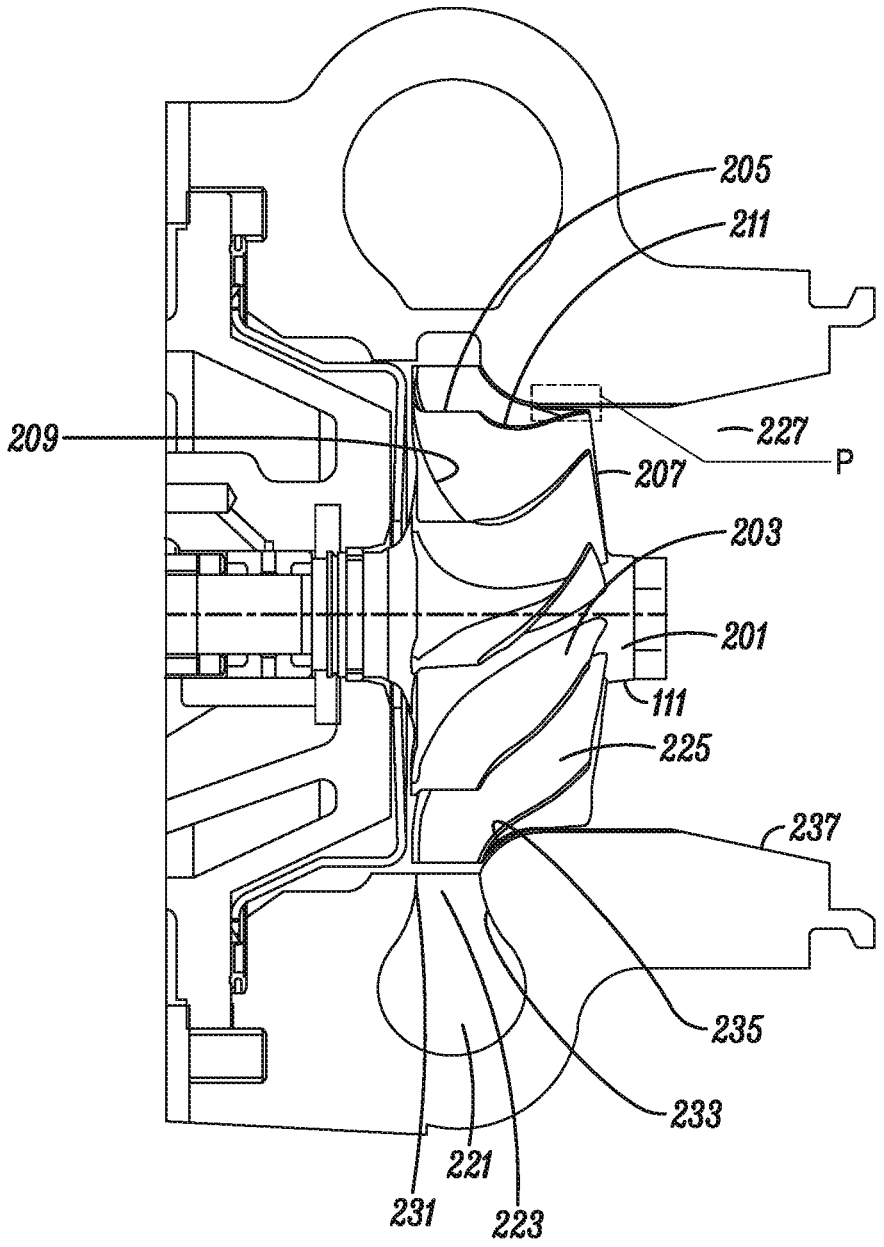
FIG. 3 is a cross-section view of a portion of a turbine, as used in the turbocharger of FIG. 2.

With reference to FIG. 3, the turbine is configured to operate over a range of flow conditions. The turbine wheel 111 has a hub 201 and a plurality of free-ended blades 203 (i.e., it is free-ended in that the blades do not carry a rotating shroud), and rotates symmetrically around the axis of rotor rotation 103. In that rotation, each blade forms a leading edge 205, a trailing edge 207, a hub edge 209 that connects to the hub, and an outer edge 211 (i.e., a shroud edge) opposite the hub edge. The hub edge and outer edge extend from the leading edge to the trailing edge. The path traveled by the outer edges of the blades through a rotation of the wheel around the axis of rotation 103 defines an axially symmetric, smoothly varying, axially concave, outer-blade effective surface.

The housing and wheel define a fluid passageway serially including a spiral volute portion 221, an inlet passageway 223 extending radially inward from the volute portion to the blade leading edges 205 (which define an inducer), a blade passageway 225 that extends from the blade leading edges to the blade trailing edges 207 (which define an exducer), and an outlet passageway 227 extending downstream from the blade passageway exducer. The fluid passageway is serially defined on an inner side by an inlet inner housing wall 231 (throughout the inlet), and by the wheel hub 201 (throughout the blade passageway). The fluid passageway is serially defined on an outer side by an inlet outer housing wall 233 (throughout the inlet), a shroud wall 235 (throughout the blade passageway) that approximately conforms to the outer-blade effective surface formed by the outer edges 211 of the rotating blades, and an outlet housing wall 237 downstream from the trailing edges. Part of the blade passageway is a blade-gap zone, which is defined to be the annular gap between the shroud wall and the outer-blade effective surface. Optionally the inlet passageway may contain some type of nozzle such as a plurality of either fixed or variable vanes.

Figure 4:
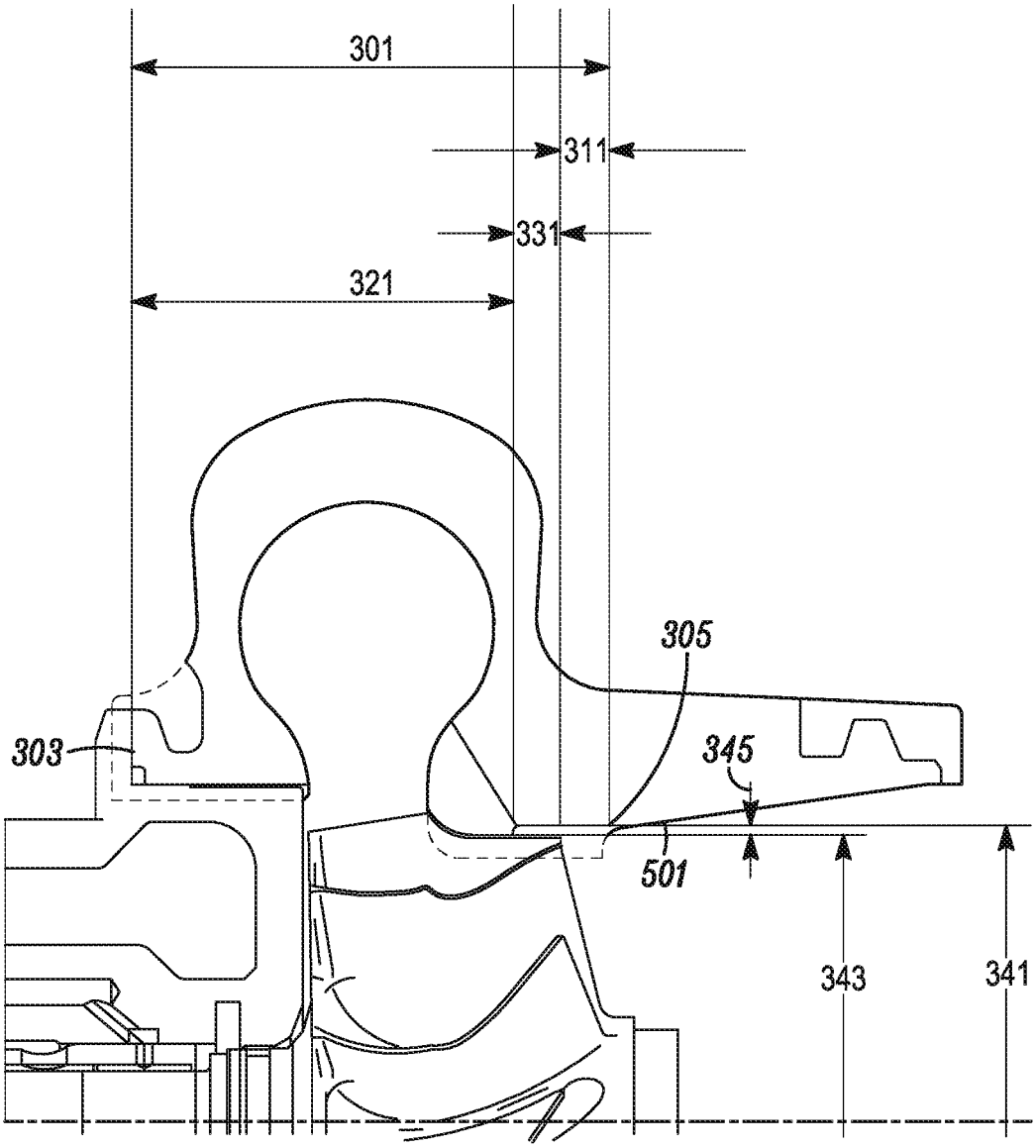
FIG. 4 is a second cross-section view of the turbine depicted in FIG. 3.

With reference to FIGS. 3 and 4, it is known for the thickness of the blade-gap zone to be substantially constant. It is also known for the outlet housing wall (downstream from the exducer) to continue on for some distance with a diameter equal to the diameter of the shroud wall at the exducer. Thus, the prior art housing may be said to be characterized by an axial reference distance 301 from an axially upstream reference point 303 to the downstream end 305 of the constant diameter portion of the housing wall downstream from the exducer. It is further characterized by an extension distance 311 representing the distance past the exducer that the downstream end 305 of the constant diameter portion extends. Finally, it is characterized by a blade-gap zone of constant thickness all the way up to the exducer. For the purposes of this application, it should be understood that at any location along the blade outer edge 211, the blade-gap zone thickness is taken normal to the blade outer edge at that location (rather than radially), and is thus the smallest distance between the blade outer edge and the shroud wall.

Under the present invention, the blade-gap zone approaching the exducer forms an annular space of varying thickness and/or diameter. More particularly, the shroud wall is characterized by a profile wherein a downstream portion of the shroud wall at the downstream end of the blade-gap zone is thicker at its downstream end than it is at its upstream end.

The outlet housing wall (downstream from the exducer) may continue on for some distance with the same diameter as was used at the exducer, or it may vary. The present housing may be said to be characterized by an axial reference distance 321 from the reference point 303 to the end of a constant blade-gap zone portion of the housing wall that is upstream of the exducer. It is further characterized by an extension distance 331, which is defined for the purposes of this application to be the axial distance between the end of a constant blade-gap zone portion of the housing wall and the exducer. It is further characterized by an exducer diameter 341 that is larger than a minimum diameter of the shroud wall 343, and by a radial increase 345, which is defined for the purposes of this application to be the radius difference between the two (i.e., one half the difference between the exducer diameter and the minimum diameter of the shroud wall). Finally, it is characterized by a blade-gap zone that varies in thickness upstream of the exducer.

Figure 5:
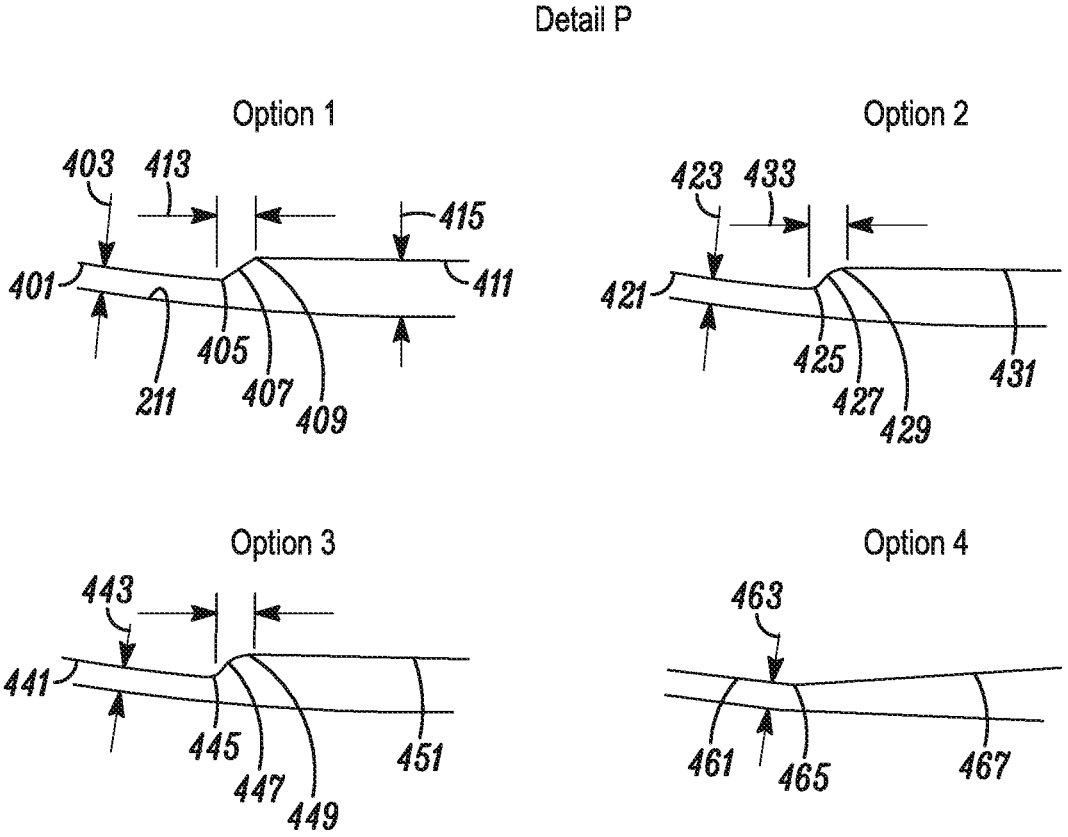
FIG. 5 is a profile view of four different options for turbine wall machining patterns.

With reference to FIGS. 3 to 5, preferred embodiments of the invention include several variations of housing wall contour in section P of the turbine depicted in FIG. 3. In a first option, the housing wall is characterized by an upstream blade-passage wall 401. The upstream blade-passage wall and the outer edge 211 form a zone of constant blade-gap thickness 403 that ends at a downstream end of the upstream blade-passage wall, which is typically characterized by a diameter that is the smallest (i.e., minimum) radial diameter of the shroud wall. The downstream end of the upstream blade-passage wall connects to a first transition blade-passage wall 407 at a first corner 405. The first transition blade-passage wall forms a blade-gap zone of increased thickness from its upstream end to its downstream end. The first transition blade-passage wall extends over an axial distance 413. At a downstream end of the first transition blade-passage wall, the housing wall forms a second corner 409 that connects to a second transition blade-passage wall 411. The second transition blade-passage wall forms a blade-gap zone of increased thickness from its upstream end to its downstream end, which is typically at the exducer.

In the first option, the first transitional blade-passage wall is downstream-facing and conical. The first and second corners 405, 409 are abrupt (i.e., sharp) corners, which is believed to provide for rapid expansion of exhaust air within the first transition blade-passage wall, as it rapidly expands the diameter of the blade-gap zone around the blades. The second transition blade-passage wall is cylindrical, and extends to the exducer. The thickness of the blade-gap zone 415 within the second transition blade-passage wall varies to the extent that the blades vary in diameter within the second transition blade-passage wall. It is believed that this option may provide a significant control over outlet temperature, with some effect over flow and efficiency.

In a second option, the shroud wall again is characterized by a upstream blade-passage wall 421 ending at and connecting to a first transition blade-passage wall 427 at a first corner 425. The first transition blade passage wall in turn ends at and connects to a second transition blade-passage wall 431 at a second corner 429, which is at a downstream end of the first transition blade-passage wall The first transition blade-passage wall 427, first corner 425 and second corner 429 form a smoothly curving transition between the upstream blade-passage wall 421 and the second transition blade-passage wall 431. These connections are rounded enough to substantially maintain laminar flow. Within the curve of the first transition blade-passage wall, the blade-passage wall forms a blade-gap zone of increasing thickness, as it expands the diameter of the blade-passage zone around the blades. The first transition blade-passage wall extends over an axial distance 433. The second transition blade-passage wall 431 is cylindrical, and extends to the exducer. The thickness of the blade-gap zone within the second transition blade-passage wall varies to the extent that the blades vary in diameter within the second transition blade-passage wall. In other words, the second option is like the first, except that the first and second abrupt corners are rounded to improve laminar flow, and this is believed to impact efficiency and flow more dramatically than outlet temperature.

Similarly, in a third option, there again is an upstream blade-passage wall 441, a first transition blade-passage wall 447, and a second transition blade-passage wall 451. The upstream blade-passage wall 441 forms a zone of constant blade-gap thickness 443 that ends at a first, abrupt corner 445 at a downstream end of the upstream blade-passage wall. The first transition blade-passage wall is concave and smoothly curves up to a second, rounded corner 449, at a downstream end, where it smoothly connects to the second transition blade-passage wall. Within the curve of the first transition blade-passage wall, the blade-passage wall forms a blade-gap zone of increasing thickness, as it expands the diameter of the blade-passage zone around the blades. The connection between the first and second transition blade-passage walls is rounded enough to substantially maintain laminar flow (to the extent possible after the air has come around the first, abrupt corner). The third blade-passage wall is cylindrical, and extends to the exducer. The thickness of the blade-gap zone within the third blade-passage wall varies to the extent that the blades vary in diameter within the third blade-passage wall. In other words, the third option is like the first, except that the first transition blade-passage wall and the second corner are rounded to improve laminar flow. Other combinations of rounded corners and curved transition blade-passage walls are also within the broadest scope of the invention.

In a fourth option, the shroud wall is characterized by a upstream blade-passage wall 461 forming a zone of constant blade-gap thickness 463 that ends at a first, abrupt corner 465 at a downstream end of the upstream blade-passage wall. The first corner connects the upstream blade-passage wall to a transition blade-passage wall 467. The transition blade-passage wall 467 wall is conical, and extends to the exducer. The transition blade passage wall forms a blade-gap zone of increasing thickness, both because the blades vary in diameter within the transition blade-passage wall, and because the wall is of increasing downstream diameter. This option may also be configured with a rounded corner and/or a curved (rather than conical) profile.

In other variations of the these embodiments, in place of a first transition blade-passage that increases in diameter in a downstream direction, the first transition blade-passage wall can be cylindrical (or even slightly decreasing in diameter in a downstream direction), wherein they extend around a blade outer surface of decreasing diameter in a downstream direction such that the blade-gap zone increases in thickness in a downstream direction.

Likewise, in other variations of the these embodiments, in place of a second transition blade-passage wall that is cylindrical, the second transition blade-passage wall can be conical (slightly increasing or decreasing in diameter in a downstream direction), wherein it extends around a blade outer surface of decreasing diameter in a downstream direction such that the blade-gap zone is larger than the blade-gap zone upstream of the first transition blade-passage wall.

It should be apparent that a primary difference between many of the options is the corner geometric configuration. For example, a primary difference between options one through three (as well as several others discussed) is the use of rounded or abrupt corners. The difference between option four (and some others) and options one through three is the use of one corner rather than two. For the purposes of this application, the corner geometric configuration is defined to be the choice of the number of corners and the abruptness/curvature of those corners within the blade passageway. For the purposes of this application, an abrupt corner is one that causes vortices that are significant enough to affect turbine efficiency, and a smoothly curving corner is a corner that supports laminar flow to the extent necessary to avoid vortices that are significant enough to affect turbine efficiency.

As is visible in FIG. 4, the shape of the blade-passage wall at the exducer is continued in the outlet housing wall 237 for the extension distance 331, at which point the outlet housing wall turns conically outward and adapts to whatever stage of the exhaust system is next in line. The corner 501 at which this outward turn occurs may be an abrupt corner, or it may be machined off into a smooth curve that accommodates laminar flow.

All of the above-described options and variations are housing wall variations that may be machined into a turbine wall. Thus, the invention is further embodied in a method of designing and customizing and manufacturing a generic turbine to meet the specific requirements of each customer. In the method, the turbine designer first tests the various combinations of the machined contours described above. Data is generated representing operational characteristics such as the flow, the efficiency, and the outlet temperature of the turbine. Using this data, the designer may then customize a turbine design based on the customer's desired flow, efficiency, and outlet temperature.

More particularly, with reference to FIGS. 3 to 6, an embodiment of the invention is a method of designing and manufacturing a turbine in response to design requirements including one or more metrics of a group of metrics. This group of metrics includes target numbers for desired turbine flow, efficiency, and outlet temperature. The metrics are considered to be optimized at their target numbers.

The method of the invention includes a plurality of steps performed in no required order other than is inherent (i.e., the numbering of the steps do not limit the order in which they are conducted). The first step is the provision of a base turbine design 601. For a given turbine manufacturer this might be a turbine designed to be used for multiple vehicle types or more simply, to embody an improvement to be sold to one or more vehicle manufacturers.

The second step is to establish the one or more metrics for the base turbine design 603. This could be done analytically, but more typically will be done by creating a physical model of the base turbine design, and then testing it for the one or more metrics.

The third step is the provision of a database of modification effects for a plurality of sets of turbine housing machining parameters 605. Each set of turbine housing machining parameters includes one or more parameters (and preferably two or three) from a group of parameters including an extension distance 331, a radial increase 345, and a corner geometric configuration. These parameters define types of turbine housing modifications that may typically be done by machining a turbine housing (or otherwise shaping the turbine housing during manufacture).

The fourth step is to select an initial set of turbine housing machining parameters for the base turbine design 607 to create a modified turbine design. This might simply be done using engineering intuition, or might be done by examining the design requirements and the analyzed/measured metrics of the base turbine design, and using the database of modification effects to identify parameters from among the one or more parameters that appear most likely to improve the extent to which the turbine meets and/or exceeds the design requirements.

The fifth step is to establish the one or more metrics (e.g., the turbine flow, efficiency, and outlet temperature) for the modified turbine design 609. As was the case with the base turbine design, this could be done analytically, but more typically will be done by creating a physical model of the modified turbine design, and then testing it for the one or more metrics.

The sixth step is to iteratively reselect the set of turbine housing machining parameters, and to reestablish the one or more metrics for the modified turbine design 611. This step is repeated until the one or more metrics are optimized to establish an optimum set of turbine housing machining parameters for the design requirements.

The seventh step is to manufacture a turbine of the base turbine design, and to manufacture (e.g., machine) the turbine housing to meet the optimum set of turbine housing machining parameters 613. It should be noted that the manufacture (e.g., machining) of the turbine housing to meet the optimum set of turbine housing machining parameters will typically be done during the manufacture of the turbine rather than after the completion of the base turbine design. Furthermore, it should be understood that the manufacturing of the turbine housing should be broadly understood to include both the machining in of features and other manufacture options such as the development of features during casting.

Figure 6:
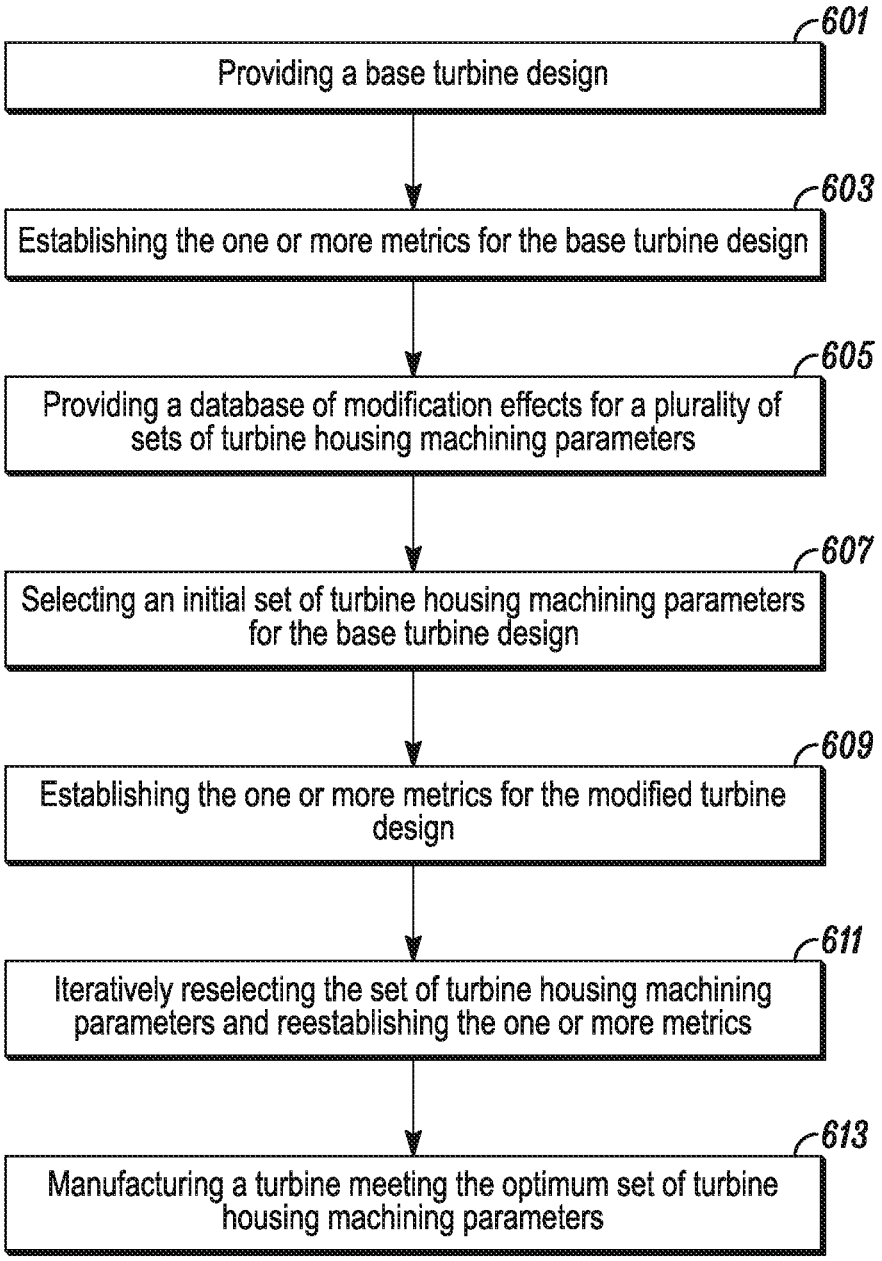
FIG. 6 depicts steps of a method under the present invention.
Figure 7:
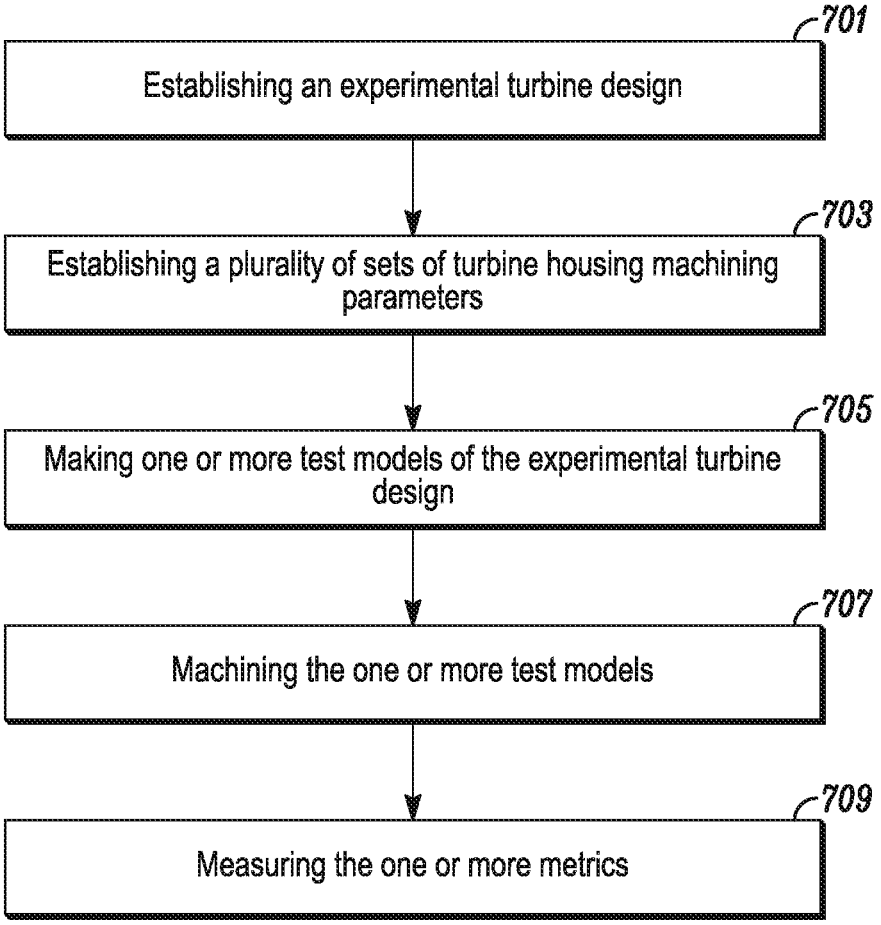
FIG. 7 depicts additional steps of the method depicted in FIG. 6.

With reference to FIGS. 6 and 7, the step of providing a database 605 includes the steps of establishing an experimental turbine design 701, establishing a plurality of sets of turbine housing machining parameters to be tested 703, making one or more test models of the experimental turbine design 705, machining the one or more test models 707 to meet each of the sets of turbine housing machining parameters, and measuring the one or more metrics 709 for each of the sets of turbine housing machining parameters.

Preferably, the experimental turbine design is the base turbine design, which provides for clear indications of which effects are predominantly indicated for changes to the turbine housing machining parameters. Nevertheless, a more generic experimental turbine design might be used for multiple base turbine designs, particularly when the base turbine designs have similar characteristics.

To provide for cost efficient development of a database of modification effects for a plurality of sets of turbine housing machining parameters, each (or some) of the one or more test models may include a housing portion and a removable insert. Thus, one (or only a few) housing portions could be manufactured, and individual inserts could be developed to provide each set of turbine housing machining parameters. Thus, each set of turbine housing machining parameters pertains to machining that is done on one insert. In some cases, an insert might be machined for a first set of turbine housing machining parameters, tested, and then again machined for a one or more additional sets of turbine housing machining parameters, and again tested for each additional set.

In such a case, the step of making one or more test models includes the steps of making a housing portion, and making a plurality of removable inserts for the housing portion, each insert being machined to meet one of the sets of turbine housing machining parameters.

It should be noted that a possible additional turbine housing machining parameter is an outlet conical geometric configuration, which for the purposes of this application includes a distance between the exducer and the point 501 at which outlet housing wall turns conically outward, and abrupt or smoothly curving nature of the corner.

It is to be understood that the invention comprises apparatus and methods for designing and producing the turbines, as well as for the turbines and turbochargers themselves. Additionally, the various embodiments of the invention can incorporate various combinations of the features described above. In short, the above disclosed features can be combined in a wide variety of configurations within the anticipated scope of the invention.

While particular forms of the invention have been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the scope of the invention. Accordingly, the invention is not intended to be limited by the above discussion, and is defined with reference to the following claims.

What is claimed is:

1. A method of designing and manufacturing a turbine to meet design requirements including one or more design metrics from a group of design metrics consisting of flow, efficiency, and outlet temperature, comprising:

providing a base turbine design;

establishing values for the one or more design metrics for the base turbine design;

providing a database of modification effects for a plurality of sets of turbine housing machining parameters, each set of turbine housing machining parameters including one or more turbine housing machining parameters from the group of turbine housing machining parameters consisting of an extension distance, a radial increase, and a corner geometric configuration;

selecting an initial set of turbine housing machining parameters for the base turbine design to create a modified turbine design;

establishing values for the one or more design metrics for the modified turbine design;

iteratively reselecting the set of turbine housing machining parameters and reestablishing values for the one or more design metrics for the modified turbine design until the values for the one or more design metrics are optimized with regard to the design requirements to establish an optimum set of turbine housing machining parameters for the design requirements; and manufacturing a turbine of the base turbine design and manufacturing the turbine housing to meet the optimum set of turbine housing machining parameters.

2. The method of claim 1, wherein the step of providing a database comprises the steps of:

establishing an experimental turbine design;

establishing the plurality of sets of turbine housing machining parameters to be tested;

making one or more test models of the experimental turbine design;

machining the one or more test models to meet each of the sets of turbine housing machining parameters; and measuring the one or more design metrics for each of the sets of turbine housing machining parameters.

3. The method of claim 2, wherein the experimental turbine design is the base turbine design.

4. The method of claim 2, wherein each of the one or more test models includes a housing portion and a removable insert, and wherein each set of turbine housing machining parameters pertains to machining that is done on the insert.

5. The method of claim 4, wherein the step of making one or more test models includes the steps of:

making the housing portion; and making a plurality of removable inserts for the housing portion, each insert being machined to meet one of the sets of turbine housing machining parameters.

6. A method of designing and manufacturing a turbine to meet design requirements including one or more design metrics from a group of design metrics consisting of flow, efficiency, and outlet temperature, comprising:

providing a base turbine design;

establishing values for the one or more design metrics for the base turbine design;

providing a database of modification effects for a plurality of sets of turbine housing machining parameters, each set of turbine housing machining parameters including one or more turbine housing machining parameters from the group of turbine housing machining parameters consisting of an extension distance, a radial increase, a corner geometric configuration, and an outlet conical geometric configuration;

selecting an initial set of turbine housing machining parameters for the base turbine design to create a modified turbine design;

establishing values for the one or more design metrics for the modified turbine design;

iteratively reselecting the set of turbine housing machining parameters and reestablishing values for the one or more design metrics for the modified turbine design until the values for the one or more design metrics are optimized with regard to the design requirements to establish an optimum set of turbine housing machining parameters for the design requirements; and manufacturing a turbine of the base turbine design and manufacturing the turbine housing to meet the optimum set of turbine housing machining parameters.

* * * * *